United States Patent [19]

Mayr

[11] 4,253,268

[45] Mar. 3, 1981

[54] PLAYTOY BUILDING BLOCK SET

[76] Inventor: August A. Mayr, Reinekestr. 34, D-8000 Munich 90, Fed. Rep. of Germany

[21] Appl. No.: 75,177

[22] Filed: Sep. 12, 1979

[30] Foreign Application Priority Data

Oct. 26, 1978 [DE] Fed. Rep. of Germany ..... 2846666

[51] Int. Cl.[3] ..... A63H 33/06

[52] U.S. Cl. ..... 46/30; 46/17; 16/128 B; 16/171; 428/33

[58] Field of Search ..... 46/30, 31, 25, 26, 27, 46/28, 29, 23, 24; 428/33; 52/578, 589, 593; 16/128 B, 171; 220/337

[56] References Cited

U.S. PATENT DOCUMENTS

| | | | |
|---|---|---|---|
| 2,709,318 | 5/1955 | Benjamin | 46/29 X |
| 2,776,521 | 1/1957 | Zimmerman | 46/30 X |
| 2,885,822 | 5/1959 | Onanian | 46/31 X |
| 3,477,167 | 11/1969 | Ach | 46/25 X |
| 3,636,589 | 1/1972 | Jacobsen | 16/171 |
| 3,881,274 | 5/1975 | Kanda | 46/30 X |
| 4,099,887 | 7/1978 | Mackenroth | 46/28 X |

FOREIGN PATENT DOCUMENTS

| | | | |
|---|---|---|---|
| 827915 | 1/1952 | Fed. Rep. of Germany | 46/29 |
| 2356930 | 5/1975 | Fed. Rep. of Germany | 46/30 |
| 46021 | 6/1939 | Netherlands | 46/29 |

*Primary Examiner*—Robert Peshock
*Assistant Examiner*—Mickey Yu
*Attorney, Agent, or Firm*—Laurence R. Brown

[57] ABSTRACT

A play building block toy set has flat plate elements of semi-elastic plastic material that interlock with pressure inserted ball socket joints. The flat plates may have various geometric shapes such as triangles, squares, etc. with each side the same length and having identical mating ball and joint locking elements. Along each block side mid-spaced between the center and two corners are respectively a ball and a socket. The ball is placed in a semi-circular cutout and is fastened by a stem to the plate. The socket is formed with a skull cap type cutout and rim members that elastically receive and hold the ball when forced or twisted thereinto. To achieve an insertion angle of 270°, the ball center and the socket center are on the bottom plane of the plate. The socket has two thickened rims extending below the plate. Means are provided for mounting shafts through holes in the plates.

12 Claims, 10 Drawing Figures

PLAYTOY BUILDING BLOCK SET

This invention relates to a playtoy building block set with flat plates made out of semi-elastic thermoplastic material having regular geometric patterns. The plates have symmetrically arranged connection joints on their edges that lock into corresponding edges of bordering building blocks so that the edges of the plates are united in many different patterns. The edges are all shaped in such a way with locking members comprising ball shaped pressure snap locking stud members extending therefrom. From the plan view looking at the plate upper surfaces in the same direction about the plate edges toward the plate corners the center of the ball member is offset from the center of the edges and the center of the snap socket receptacle is offset in the opposite direction so that the center point of the ball and of the socket lies on the plane of the underside of the plate and on the edge of the plate. The balls are centrally located in a semi-circular cutout in the plate and are attached to the plate by a shaft smaller in cross section than the ball. The diameter of the cutout is smaller than the outside diameter of the socket so that the socket closing about a twisted ball retains the ball with its lower rim reaching under the plate underside by means of a skull cap like cutout in the plate rim that springingly admits the ball.

It is an object of the aforesaid invention to provide such building element principles that more configurations and possibilities of combinations of a single element result and particularly to increase the insertion swivel angle for locking the ball snap member.

In accordance with the invention this objective is achieved in that the ball receiving socket has a thicker dimension cutout in the bottom spreading region part on the underside of the plate. By this achievement the insertion swivel angle for locking is increased to 270° from prior building block angles in the order of 180°.

Further advantages and details are set forth in the description.

The drawings shows . . .

Figure 2:
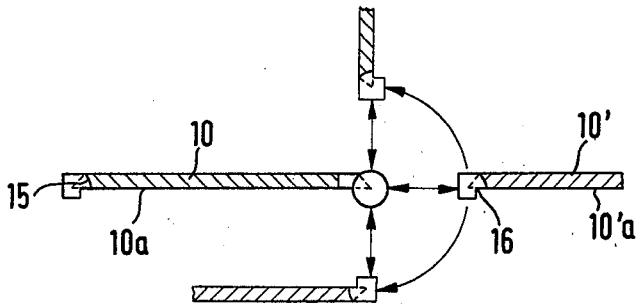
Figure 1:
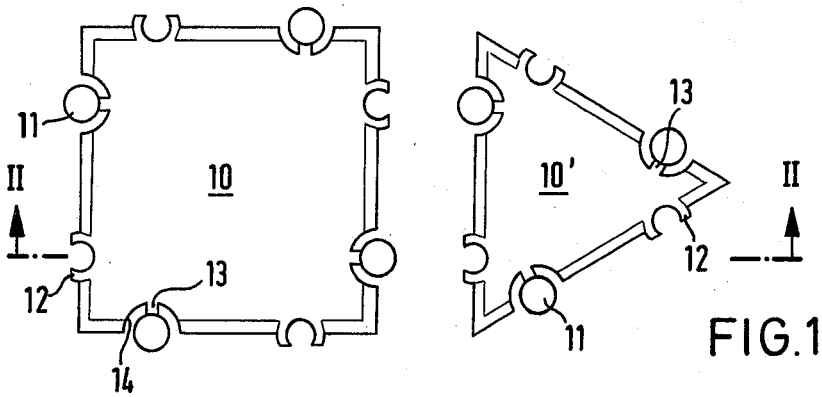
Figure 4:
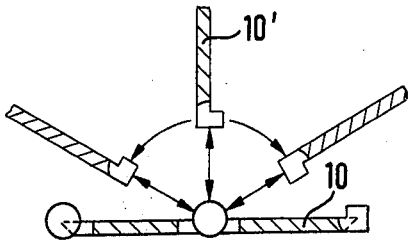
Figure 3:
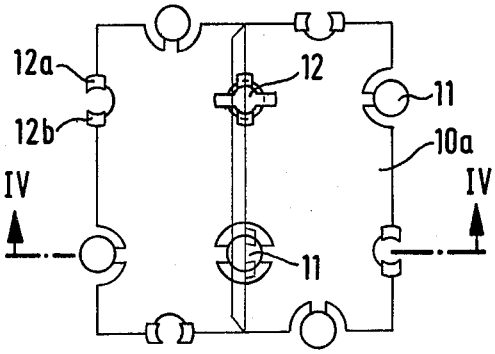
Figure 5:
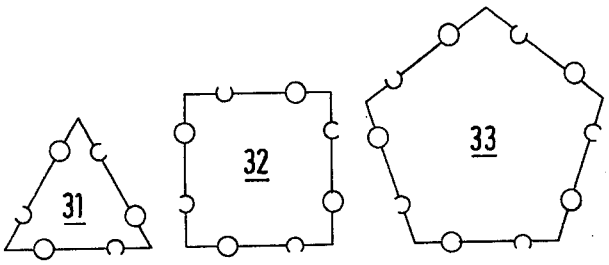
Figure 6:
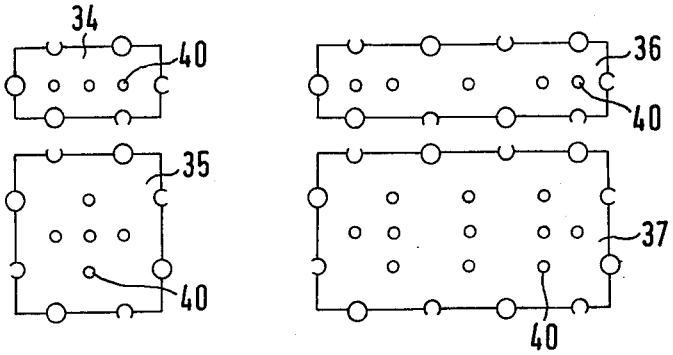
Figure 7:
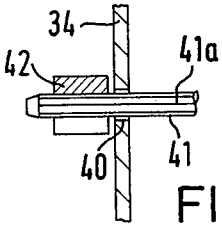
Figure 8:
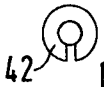
Figure 10:
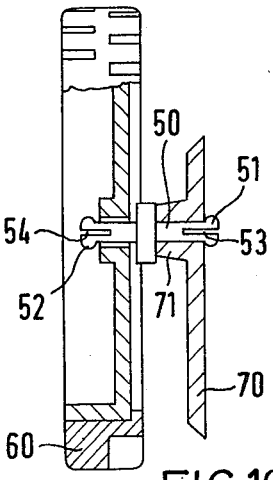
Figure 9:
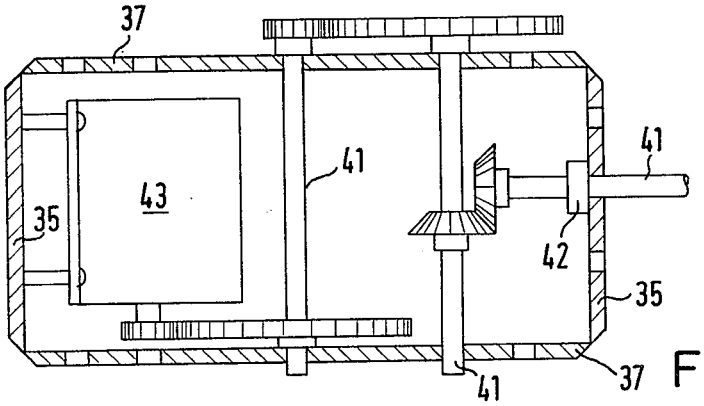

FIG. 1 a top view of two plate elements,

FIG. 2 a sketch illustrating the insertion swivel angle possibilities of the combined together elements of FIG. 1, FIG. 3 a variation of the plate elements, FIG. 4 a sketch illustrating the locking and insertion swing angle possibilities for a plate element as in FIG. 3, FIGS. 5 and 6, top views of plate elements of various geometric shapes, FIG. 7 a partial section through a plate element with an axle extending therethrough, FIG. 8 a top view of a clip spring as used in the arrangement of FIG. 7, FIG. 9 sketches of a driving block made of different assembled building elements, and FIG. 10 a partial section through a plate element with an axle and rotating wheel.

FIG. 1 shows a square plate 10 and a triangular plate 10' made of a semi-elastic thermoplastic material, which as can be seen from FIG. 2 has a thick border rim, preferably molded. The side edges of the plates 10 and 10' are of the same length.

On each side of the plate 10 are placed fastening elements which are formed as button snap ball and socket sets comprising a ball 11 and a socket 12. Looking into the plate 10 from above, as shown in FIG. 1, the ball 11 on each side of the plate is always displaced from the center of the side in the same direction and also the same distance, with the socket 12 likewise placed in the opposite direction from the center of the side. In the foregoing case, the distance the ball 11 and socket 12 is offset from the center point of the side is exactly one quarter of the length of the side. The same is true for the ball and socket of the triangular plate 10'.

While the socket 12 is directly formed on the edge of the plate 10, the ball 11 extends freely from a shaft 13 inside a semi-circular cutout 14 in the plate having a common center point with the ball 11. The shaft preferably has the same thickness as the plate lamination, but can be rounded on its edges so that it has a circular shape in cross section.

It can be understood from FIGS. 1 and 2 that the center of the ball and socket 12 lies in the plane of the underside **10*a* of the plate 10 and commonly on the edge of the plate 10. Also from FIG. 2 it is understood that the socket 12 has a rim extending under the bottom side 10*a* of the plate 10 a distance such as to form a ball holding rim into which the ball 10 is forced. Accordingly the placement of the ball 11 into the socket 12 not only is possible from the underside 10*a* of the plate 10 but the socket 12 by means of its rim extending from the plate underside and having a skull cap type cutout 15 in the rim, the ball 11 also can be placed into the socket 12 when it is shoved thereinto in the plane of the plate 10. It is understood that the size of the skull cap type cutout 15 is selected that when using the elastic property of the socket walls it is possible to snap the ball into the socket. The socket 12 nevertheless has a wider opening into the skull cap type cutout 16 on the underside 10*a* of the plate encircling the bottom of the socket, as best seen from FIG. 2. In other words on the underside 10*a* of the plate the bottom of the socket is removed so that the socket as viewed in plan from the underside 10*a* of the plates 10 simply comprise two curved socket ribs 12*a* and 12*b* as may be seen from the later to be explained FIG. 3 In conclusion that part of the socket 12 that extends from the upper side of the plates is removed so that the upperside of the plate in the region of the socket 12** is planar.

FIG. 2 shows the versatile holding joint of the plates 10 and 10' where is shown the greatest possible rotation of the plate 10' about the plate 10 in the direction of both uppersides of plates 10 and 10' including a position with both undersides together. From the figure it is seen that both the upper sides of the plates 10 and 10' can be arranged at 90° to each other, while both undersides **10*a* and 10'*a* can approach each other until they directly contact. The latter is possible because of the skull cap type cutout 16 in which as the plate undersides 10*a*, 10'*a* come into contact the shaft 13 of the ball 12** is inserted.

The fact that no outstanding socket parts extend on the upperside of the plates facilitates the revolving of the plate upper sides with respect to each other until they reach 90°. Because of the particular configuration of the socket 12, thereby it is possible to attain a rotation angle of 270°. The particular geometric location of the center of ball 11 and the socket 12 moving with respect to each other, so that the edges of the plates 10 and 10' essentially come together with no spacing between them. A requisite for the gapless combination of the plates is that the radius of the cutout 14 surrounding ball 11 is less than that of the outside radius of the socket.

FIG. 3 shows a plate element similar to that of FIG. 1 but differing by an additional locking means in the center of the plate. This locking means also comprises a ball and socket which in their form and in their spacing from each other correspond fully to the ball and socket on the plate edge. The center of the ball and of the socket are placed on the crossing line between the center line of the plate and a line between the ball and socket on the plate edges. The locking of these elements 10 with the element 10' is shown in FIG. 4, wherein the assembly rotation angle is about 120''. The FIGS. 5 and 6 show several possible basic shapes, which provide many different construction possibilities. The plate elements are labelled 31, 32, 33 34, 35, 36 and 37. The plates 34, 35, 36 and 37 of FIG. 6 are provided with openings 40 extending therethrough in order to permit axles to be passed through. FIG. 7 shows one axle 41 passed through the opening 40 of element 34 and secured by a clip spring ring 42. The axle 41 is constructed of metal and contains longitudinal ribs 41*a*, while the clip spring ring 42, shown in FIG. 8 in plan view, is made of the same thermoplastic material of which the plates including plate 34 are constructed. By means of the harder material in locking upon the longitudinal ribs of the axle 41 the force on the spring clip ring 42 mounted on the axle required to press it on is small with the consequence that ring 42 and axle 41 when mounted cannot be twisted without expenditure of high energy. The building element 42, which is unrotatably mounted on the axle 41, can of course have other forms, for example the form of a traction wheel, a disc, a gear wheel, a cone shaped gear, or the like. Accordingly the axle retainer need not necessarily be made in the form of a spring clip ring, but can instead be a closed bore or a bushing attachment with the requisite that the inner diameter of the bore or of the bushing smallest diameter is smaller than the outer measure of the axle 41. Also in this case somewhat more pressure can be used to force the axle into the bore or the bushing so that relative rotation with each other is not possible. An example of this type of driving assembly put together of building blocks is shown in FIG. 9. There the housing is made of plate elements 35 and 37. Through the openings 40 of these plate elements are disposed axles 41, which by way of clip spring ring 42 are secured and carry various gear wheels and cone shaped gears. A driving motor 43 is fastened to housing.

FIG. 10 finally shows yet another form of an axle, namely the axle 50 made out of thermoplastic material. This axle has thickened ends 51, 52 provided with the slits 53. The axle 50 in this example holds a drive traction wheel 60 to the plate element 70 so that the axle extends through the plate 70, which in place of the bores 40 of FIG. 6 has instead about the bore a strengthened bushing member 71.

Note that as shown in FIGS. 1 through 4 the socket structure that permits the increased range of rotation of elements to 270°, as set forth in FIG. 2, include features as follows:

(a) The socket structure 12 has a circular cut-out extending through the plate 10 with a semi-circular thickened rim portion 12*a*, 12*b* located on both sides of the edge of the plate 10 and extending on the underside below the plate surface.

(b) The socket structure 12 has two opposed thickened rim members 12*a*, 12*b* lined along the edge of the building element 10 for elastically engaging the ball 11.

(c) The socket structure 12 has a semi-cylindrically shaped profile with two rim members that are positioned within the circular plate cutout region surrounding the ball 11 in different positions as the plates are relatively rotated.

I claim:

1. Toy building element sets comprising a plurality of building blocks in the form of generally planar square plates of semi-elastic plastic material with each side having similar mating snap locking elements therein of the ball and socket elastic pressure engagement type, said plates having a planar upper surface with the ball and socket elements having their center located on the edge of the plates and terminating at the lower planar surface of the plates so that the ball and socket elements extend upwardly from the lower planar surface of the plates, a further set of ball and socket elements located along the centerline of said plates, and said ball and socket elements of each side including structures permitting two adjacent interlocked plates to be disposed at angles to each other over a range of 0° to 270°.

2. Building element sets as defined in claim 1 with said elements wherein the socket has a skull cap type cutout for receiving the ball in mating position terminating in a set of two springable elastic rim members extending downwardly from the plate to admit and retain the ball by elastically spreading when the ball is forced into the socket by pressure.

3. Building element sets as defined in claims 1 or 2 wherein the blocks have on each edge one ball member and one socket member respectively located on opposite sides of the center of the edge midway between that center and the adjacent corners of the block.

4. Building element sets as defined in claims 1 or 2 including at least one opening through at least one plate with a rotatable axle mounted therethrough.

5. Building element sets as defined in claim 4 wherein the plate has an axle supporting bushing integrally formed therein to extend about the opening on one side of the plate.

6. Building element sets as defined in claim 4 wherein the axle comprises a semi-elastic plastic material with thickened slitted opposite ends.

7. Building element sets as defined in claim 5 wherein the axle is held in said opening by a retaining member.

8. Building element sets as defined in claim 7 wherein the retaining member comprises a spring clip ring.

9. Building element sets as defined in claim 7 wherein the axle is a metallic shaft having longitudinally extending ribs thereon.

10. Building element sets as defined in claim 1 wherein the socket structure comprises a circular cutout extending through said plates.

11. Building element sets as defined in claim 10 wherein the socket comprises rim members extending beyond the plate on opposite sides of the cut-out, and the ball extends from said plates on a shaft and is surrounded by a semi-circular cutout which is positioned to permit the rim members to take different positions therein when the socket is snapped about the ball.

12. Building element sets as defined in claim 1 wherein the socket comprises two opposed thickened rim members positioned on either side of a line passing through the edge of the plates.

* * * * *